US007090717B2

(12) United States Patent
Kim et al.

(10) Patent No.: US 7,090,717 B2
(45) Date of Patent: Aug. 15, 2006

(54) AIR PURIFIER

(75) Inventors: Young-Saeng Kim, Incheon (KR); Chan-Jung Park, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 87 days.

(21) Appl. No.: 10/453,519

(22) Filed: Jun. 4, 2003

(65) Prior Publication Data

US 2004/0118284 A1 Jun. 24, 2004

(30) Foreign Application Priority Data

Dec. 23, 2002 (KR) ..... 10-2002-0082687

(51) Int. Cl.
*B03C 3/40* (2006.01)

(52) U.S. Cl. ..... 96/84; 96/95; 96/100

(58) Field of Classification Search ..... 96/67, 96/84, 86, 87, 95, 96, 100; 95/78; 55/DIG. 38
See application file for complete search history.

(56) References Cited

U.S. PATENT DOCUMENTS

| | | | | | |
|---|---|---|---|---|---|
| 1,356,462 | A | * | 10/1920 | Nesbit | 96/87 |
| 1,357,202 | A | * | 10/1920 | Nesbit | 96/75 |
| 2,588,111 | A | * | 3/1952 | Hanneman | 204/668 |
| 2,997,519 | A | * | 8/1961 | Hines et al. | 174/28 |
| 3,237,382 | A | * | 3/1966 | Berly | 96/67 |
| 4,354,858 | A | * | 10/1982 | Kumar et al. | 95/78 |
| 4,509,958 | A | * | 4/1985 | Masuda et al. | 96/60 |
| 4,781,736 | A | * | 11/1988 | Cheney et al. | 96/60 |
| 5,547,493 | A | * | 8/1996 | Krigmont | 96/54 |
| 5,647,890 | A | * | 7/1997 | Yamamoto | 95/69 |
| 5,938,818 | A | * | 8/1999 | Miller | 95/63 |
| 6,294,003 | B1 | * | 9/2001 | Ray | 96/49 |
| 6,482,253 | B1 | * | 11/2002 | Dunn | 96/62 |
| 6,524,369 | B1 | * | 2/2003 | Krigmont | 95/78 |
| 6,679,940 | B1 | * | 1/2004 | Oda | 96/55 |

FOREIGN PATENT DOCUMENTS

| | | | |
|---|---|---|---|
| KR | 1019970065580 | | 9/1999 |
| KR | 1020010010398 | | 9/2002 |
| WO | WO 01/19419 | * | 3/2001 |

OTHER PUBLICATIONS

U.S. Appl. No. 10/452,152, filed Jun. 3, 2003, Young-Saeog Kim et al., Samsung Electronics Co., Ltd.

* cited by examiner

*Primary Examiner*—Richard L. Chiesa
(74) *Attorney, Agent, or Firm*—Staas & Halsey LLP

(57) ABSTRACT

An air purifier has a simply manufactured and assembled ionizer, which improves the charging efficiency for dust particles using multi-directional discharge and prevents electrical accidents. The air purifier includes an ionizer and a collector. The ionizer includes a first electrode and at least two second electrodes, the first electrode having at least two hollow, semi-cylindrically shaped electrodes, the at least two electrodes being connected successively and in parallel so that the first electrode has a corrugated shape, and the at least two second electrodes are positioned at inner spaces defined by the hollow semi-cylindrically shaped electrodes, respectively. The collector is electrically charged with a polarity opposite to a polarity of charged dust particles.

11 Claims, 8 Drawing Sheets

AIR PURIFIER

CROSS-REFERENCE TO RELATED APPLICATIONS

This application claims the benefit of Korean Application No. 2002-82687, filed Dec. 23, 2002, in the Korean Intellectual Property Office, the disclosure of which is incorporated herein by reference.

BACKGROUND OF THE INVENTION

1. Field of the Invention

The present invention relates generally to an air purifier and, more particularly, to an air purifier which includes an electric dust collecting device that electrically charges dust particles in air and collects the charged dust particles.

2. Description of the Related Art

As is well known to those skilled in the art, an air purifier is used to provide purified clean air after dust, bacteria and contaminants in air are eliminated. The air purifier is provided with an electric dust collecting device to collect dust, etc. In the electric dust collecting device, dust particles electrically charged by corona discharge of an ionizer are collected by electrostatic attraction of a collector electrically charged to have a polarity opposite to a polarity of the charged dust particles.

FIG. 1 is a side sectional view of a conventional air purifier. As shown in FIG. 1, the conventional air purifier includes a pre-filter 102, an ionizer 104, a collector 106, a final filter 108, and a fan 110. The pre-filter 102 acts primarily to filter relatively large dust particles. The ionizer 104, which constitutes the electric dust collecting device along with the collector 106, functions to charge the dust particles electrically to bear a positive polarity by corona discharge between a discharge electrode unit 104*b* and ground electrode units 104*a* positioned at both sides of the discharge electrode 104*b*. The collector 106 has a plurality of horizontal partitions 106*a* bearing a negative polarity. When the positively charged dust particles flow between the horizontal partitions 106*a* of the collector 106, the dust particles are adsorbed to, and collected on, the negatively charged horizontal partitions by electrostatic attraction. The final filter 108 functions to filter fine dust or mold not filtered by the collector 106. The fan 10 circulates air by forcibly circulating air from the pre-filter 102 to the final filter 108.

In the above-described conventional air purifier, when the discharge electrode unit 104*b* and the ground electrode units 104*a* constituting the ionizer 104 are perpendicular to each other, the discharge occurs. However, if plate-shaped ground electrodes are used, discharge spaces are limited to very small spaces, so that some of dust particles, which quickly move along circulating air generated by the fan 110, may not be electrically charged. The dust particles not electrically charged in the ionizer 104 are not collected by the collector 106, so that the filtering burden of the final filter 108 positioned behind the electric dust collecting device is increased.

SUMMARY OF THE INVENTION

Accordingly, it is an aspect of the present invention to provide an air purifier that has a simply manufactured and assembled ionizer, which improves the charging efficiency for dust particles using multi-directional discharge and prevent electrical accidents.

Additional aspects and advantages of the invention are set forth in part in the description which follows and, in part, will be obvious from the description, or may be learned by practice of the invention.

The foregoing/or and other aspects of the present invention are achieved by providing an air purifier including an ionizer comprising a first electrode and two or more second electrodes, the first electrode having two or more electrodes each formed to have a hollow semi-cylindrical shape, the two or more electrodes being connected successively and in parallel so that the first electrode is formed to have a corrugated or wave shape, the two or more second electrodes being positioned at inner spaces defined by the hollow semi-cylindrically shaped electrodes, respectively, and a collector electrically charged to have a polarity opposite to the polarity of the charged dust particles.

The foregoing and/or other aspects of the present invention are achieved by providing an ionizer of an electric dust collection device, including a first electrode comprising two or more electrodes each provided with a plurality of air holes to pass air therethrough and each formed to have a hollow semi-cylindrical shape, the two or more electrodes being connected successively and in parallel so that the first electrode is formed in a corrugated shape, and two or more second electrodes positioned at inner spaces defined by the hollow semi-cylindrically shaped electrodes, respectively, wherein the first electrode is manufactured as a single part.

The foregoing and/or other aspects of the present invention are achieved by providing a ground electrode unit of an electric dust collection device electrically charging dust particles including a plurality of electrodes, each provided with a plurality of air holes to pass air therethrough and each formed in a hollow semi-cylindrical shape, the plurality of electrodes being connected successively and in parallel so that the first electrode is formed in a corrugated shape, wherein the ground electrode unit is manufactured as a single part by a pressing process using a single plate.

The foregoing and/or other aspects of the present invention are achieved by providing a ground electrode unit of an electric dust collection device electrically charging dust particles including a plurality of electrodes, each provided with a plurality of air holes to pass air therethrough and each formed in a hollow semi-cylindrical shape, the plurality of electrodes being successively and in parallel connected so that the first electrode is formed in a corrugated shape, wherein the ground electrode unit is manufactured as a single part by a casting process.

It is an aspect of the present invention to provide an ionizing air purifier comprising a wave shaped unit having a plurality of first electrodes connected successively and in parallel and having a plurality of air holes to pass air therethrough; at least two second electrodes positioned at inner spaces defined by the wave shaped unit, respectively; and a collector, proximate to the wave shaped unit, being electrically charged to have a polarity opposite to a polarity of charged dust particles. The wave shaped unit may, for example, be sine wave shaped, square wave shaped, or may include a plurality of wave shapes.

It is another aspect of the present invention to provide a ground electrode unit of an electric dust collection device electrically charging dust particles, comprising a wave shaped unit having a plurality of electrodes connected successively and in parallel and having a plurality of air holes to pass air therethrough, wherein the wave shaped unit is manufactured as a single part by a pressing process using a single plate. The wave shaped unit may, for example, be sine wave shaped, square wave shaped, or may include a plurality of wave shapes.

It is another aspect of the present invention to provide a ground electrode unit of an electric dust collection device electrically charging dust particles comprising a wave shaped unit having a plurality of electrodes connected successively and in parallel and having a plurality of air holes to pass air therethrough, wherein the ground electrode unit is manufactured as a single part by a casting process. The wave shaped unit may, for example, be sine wave shaped, square wave shaped, or may include a plurality of wave shapes.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF EMBODIMENTS

Figure 1:
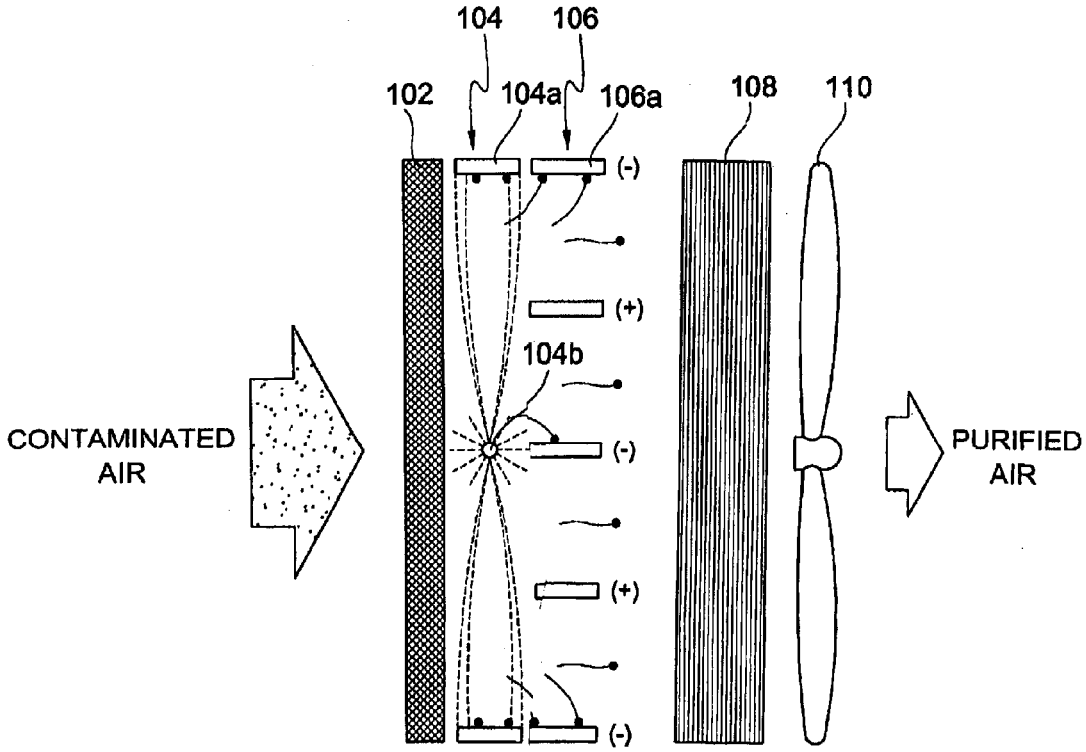
FIG. 1 Prior Art
FIG. 1 is a side sectional view of a conventional air purifier.

Reference is now made in detail to the present preferred embodiments of the present invention, examples of which are illustrated in the accompanying drawings, wherein like reference numerals refer to the like elements throughout. The embodiments are described below in order to explain the present invention by referring to the figures.

Figure 2:
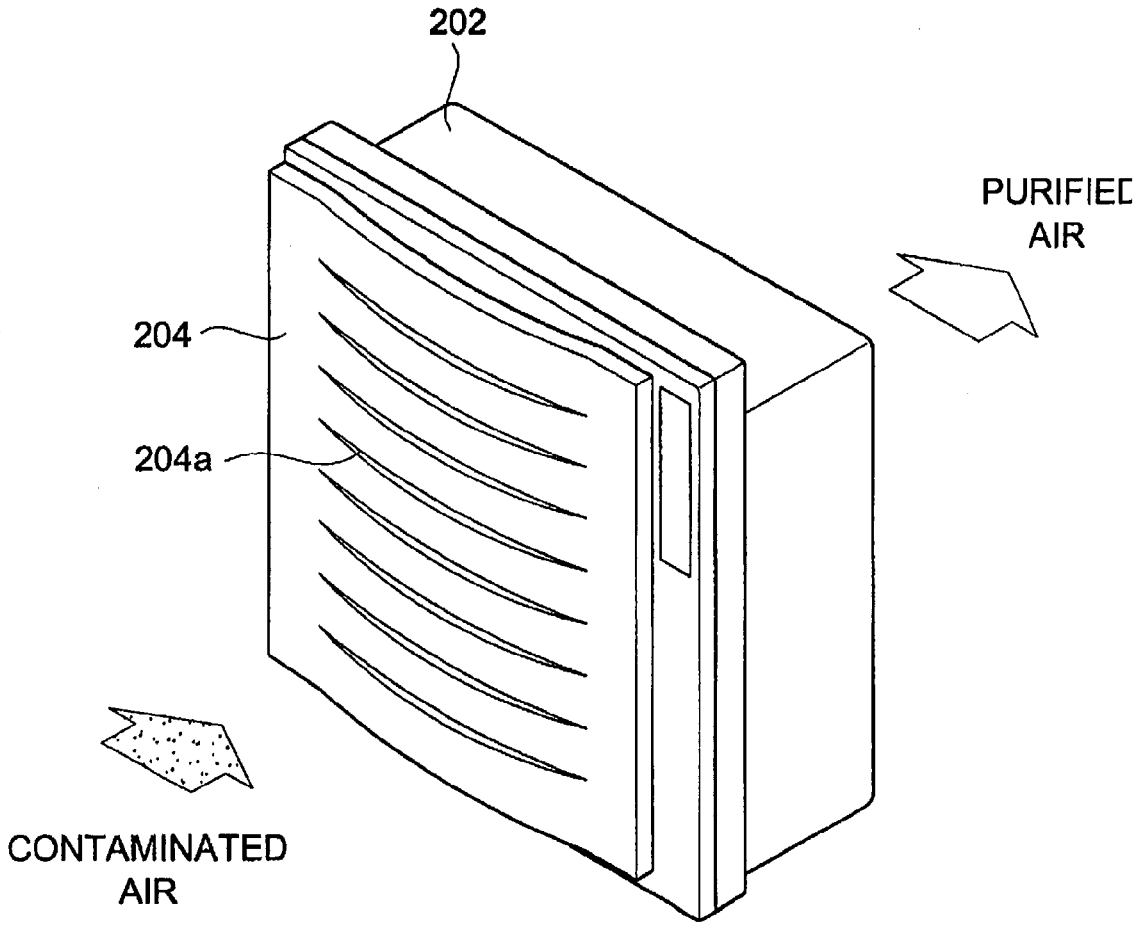
FIG. 2 is a perspective view of an air purifier, according to an embodiment of the present invention.

Embodiments of an air purifier according to the present invention are described in detail with reference to FIGS. 2 to 6. FIG. 2 is a perspective view of an air purifier, according to the present invention. As shown in FIG. 2, a main body 202 of the air purifier is equipped with a cover 204 at a front thereof, which is provided with a plurality of air suction slits 204a so that external air is sucked into the main body 202. That is, through the air suction slits 204a, air including contaminated materials is sucked into the main body 202, such that the main body 202 functions to remove the contaminated materials, such as dust particles, thus purifying the air. The purified air is discharged through an air exhaust port (not shown) positioned at a back of the main body 202 to an outside of the air purifier.

Figure 3:
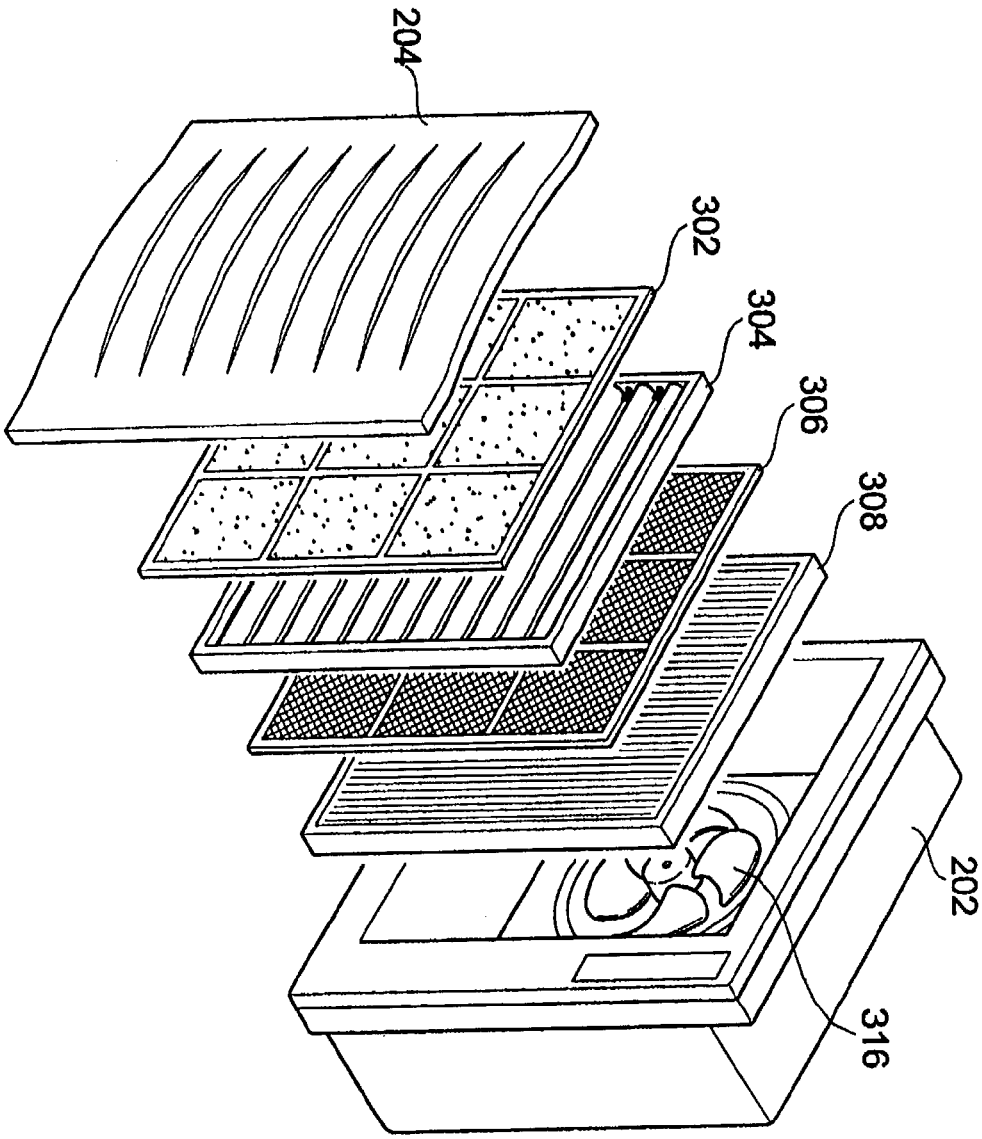
FIG. 3 is an exploded perspective view of the air purifier of FIG. 2.

FIG. 3 is an exploded perspective view of the air purifier of FIG. 2. As shown in FIG. 3, the air purifier of the present invention includes a pre-filter 302, an ionizer 304, a collector 306, and a HEPA (High Efficiency Particulate Air) filter 308, sequentially disposed from the front to the back of the main body 202 thereof. Further, a fan 316 is equipped at the very rear of the main body 202 to circulate air forcibly from the front to the back of the main body 202. While the fan 316 is rotated, air flows from the front to the back of the main body 202, so that room air is circulated through the air purifier.

Each filter and an electric dust collecting device shown in FIG. 3 function as described below. The pre-filter 302 is used primarily to filter relatively large dust particles. The ionizer 304 and the collector 306 serve as an electric dust collecting device, in which dust particles positively charged in the ionizer 304 are adsorbed to, and collected on, the negatively charged collector 306 by electrostatic attraction. The dust particles remaining in the air after passing through the collector 306 are filtered by the HEPA filter 308. The HEPA filter 308 is used to collect microparticulates such as fine dust or bacteria having very small DOP (Di-Octyl phthalate) (e.g., about 0.3 μm).

Figure 4A:
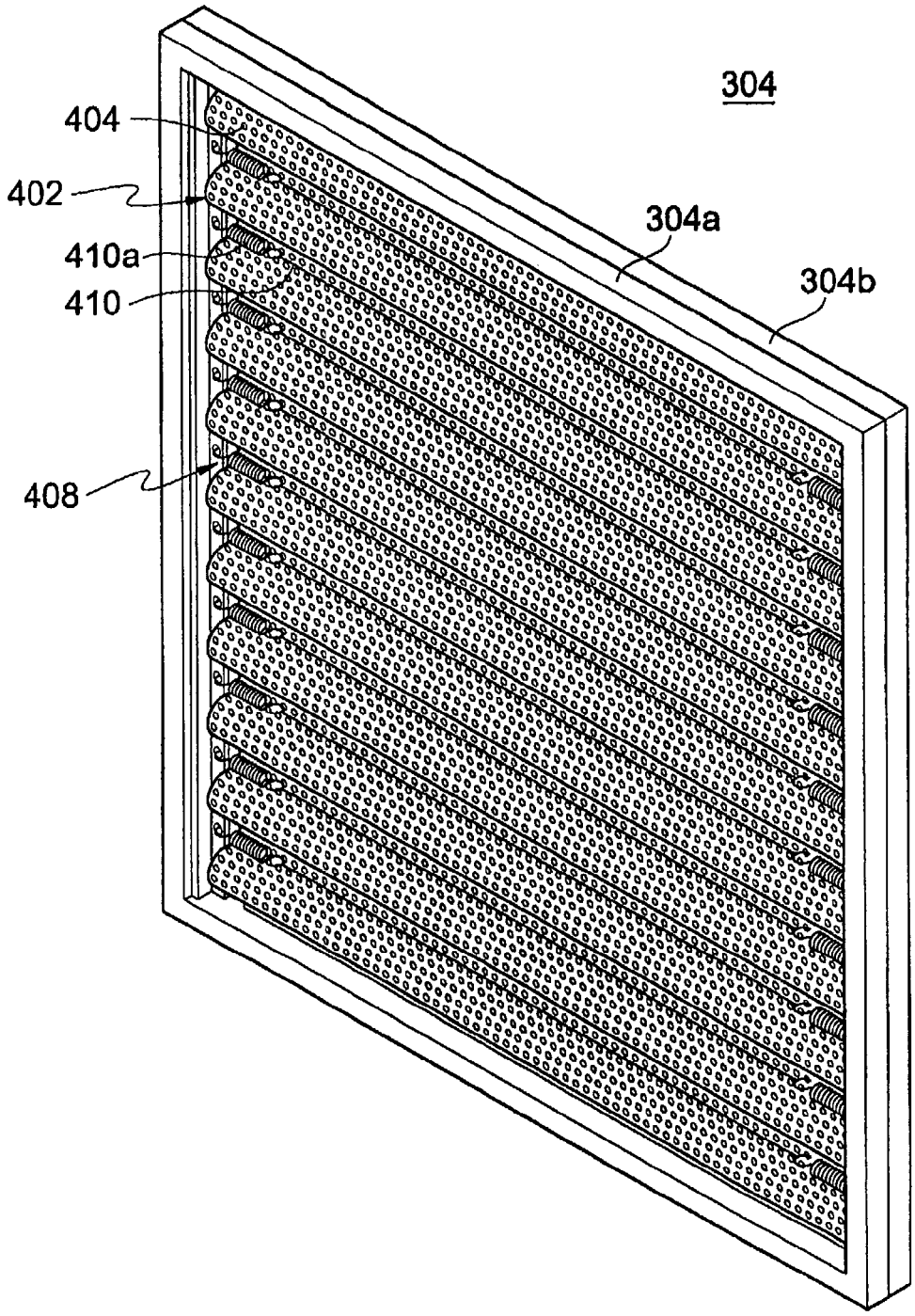
FIG. 4A is a front perspective view of an ionizer of the air purifier, according to an embodiment of the present invention.

FIG. 4A is a front perspective view of the ionizer of the air purifier, according to an embodiment of the present invention. As shown in FIG. 4A, the ionizer 304 of the present invention includes a ground electrode unit 402 fixedly disposed in a frame having an upper portion 304*a* and a lower portion 304*b*. The ground electrode unit 402 includes a plurality of electrodes 408, which are connected successively and in parallel. Each electrode of the plurality of electrodes 408 is formed in a hollow semi-cylindrical shape. The plurality of electrodes 408 are arranged so that the hollow semi-cylindrically shaped electrodes 408 are alternately protruded, so that the ground electrode 402 is formed in a corrugated shape. The number of the electrodes 408 is greater than one. In order to increase the charging efficiency for dust particles and the like, the area of the ground electrode unit 402 may be broadened and form a number of electrodes 408. A plurality of air holes 404 are perforated in the surface of the ground electrode unit 402, so air is forcibly blown by the fan 316 and smoothly circulated through the air holes 404. The air holes 404 may be formed in any shape, such as a circle, an ellipse, a polygon and the like, if the shape allows air and dust to pass smoothly therethrough.

Discharge electrodes 410 made of tungsten wires are fixedly connected to both side ones of four inner surfaces of the frame through springs 410*a*, 412*a* (FIG. 4B), which are elastic members, thus having a predetermined tension. The intervals of the electrodes 410 are proportional to the intervals of the electrodes 408 of the ground electrode unit 402. The discharge electrodes 410 are fixedly disposed in the frame 304*a*, 304*b* positioned in inner spaces defined by the hollow semi-cylindrically shaped electrodes 408. The discharge electrodes 410 are generally each disposed at a position where distances between the inner surface of each of electrodes 408 and a corresponding discharge electrode 410 are uniform, respectively. When the discharge electrodes 410 are each disposed at a position where distances between the inner surface of each of electrodes 408 and a corresponding discharge electrode 410 are uniform, discharge spaces between the discharge electrodes 410 and the ground electrode unit 402 are greatly increased, so the charging efficiency for dust particles may be maximized.

Figure 4B:
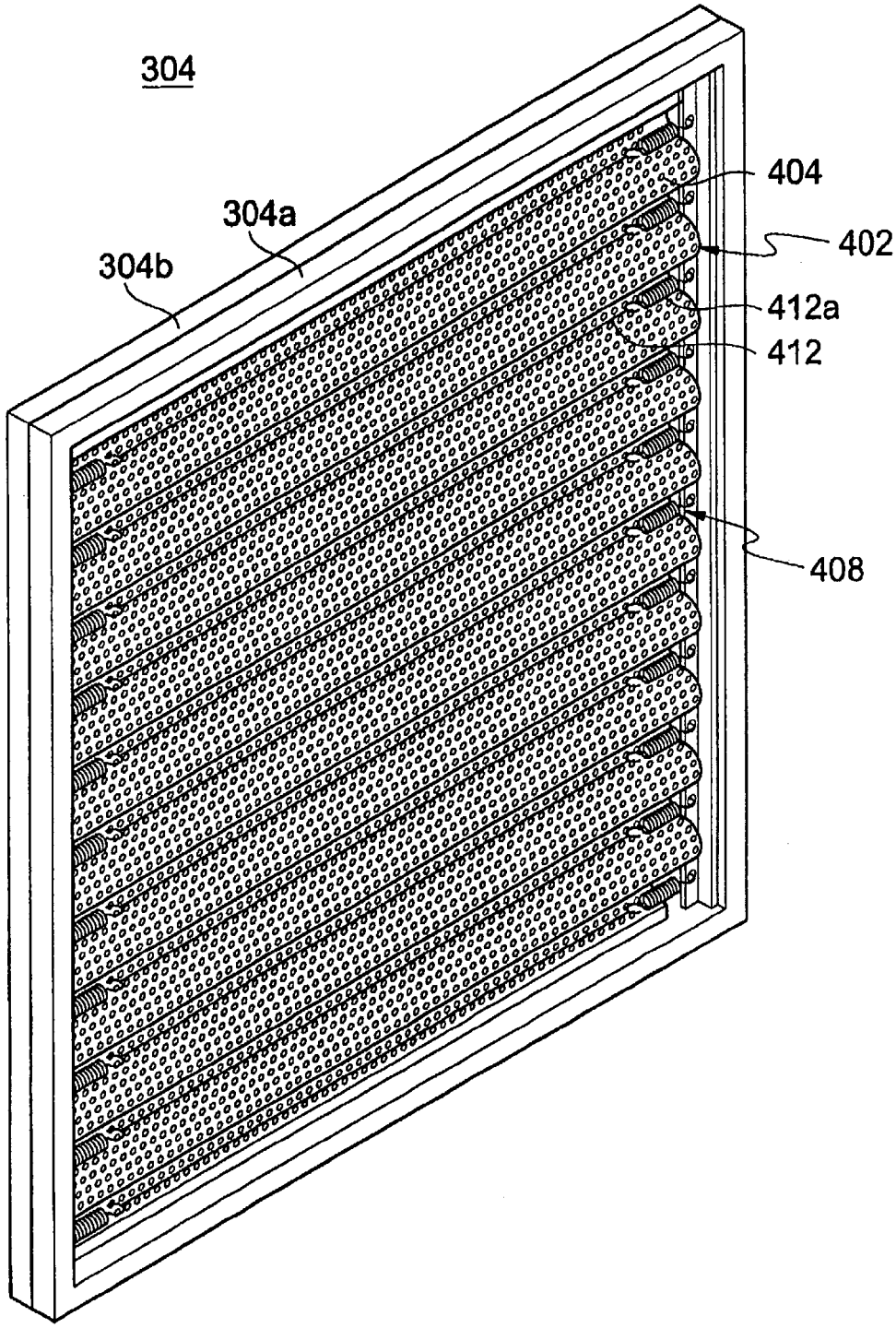
FIG. 4B is a rear perspective view of the ionizer of the air purifier of FIG. 4A.
Figure 4C:
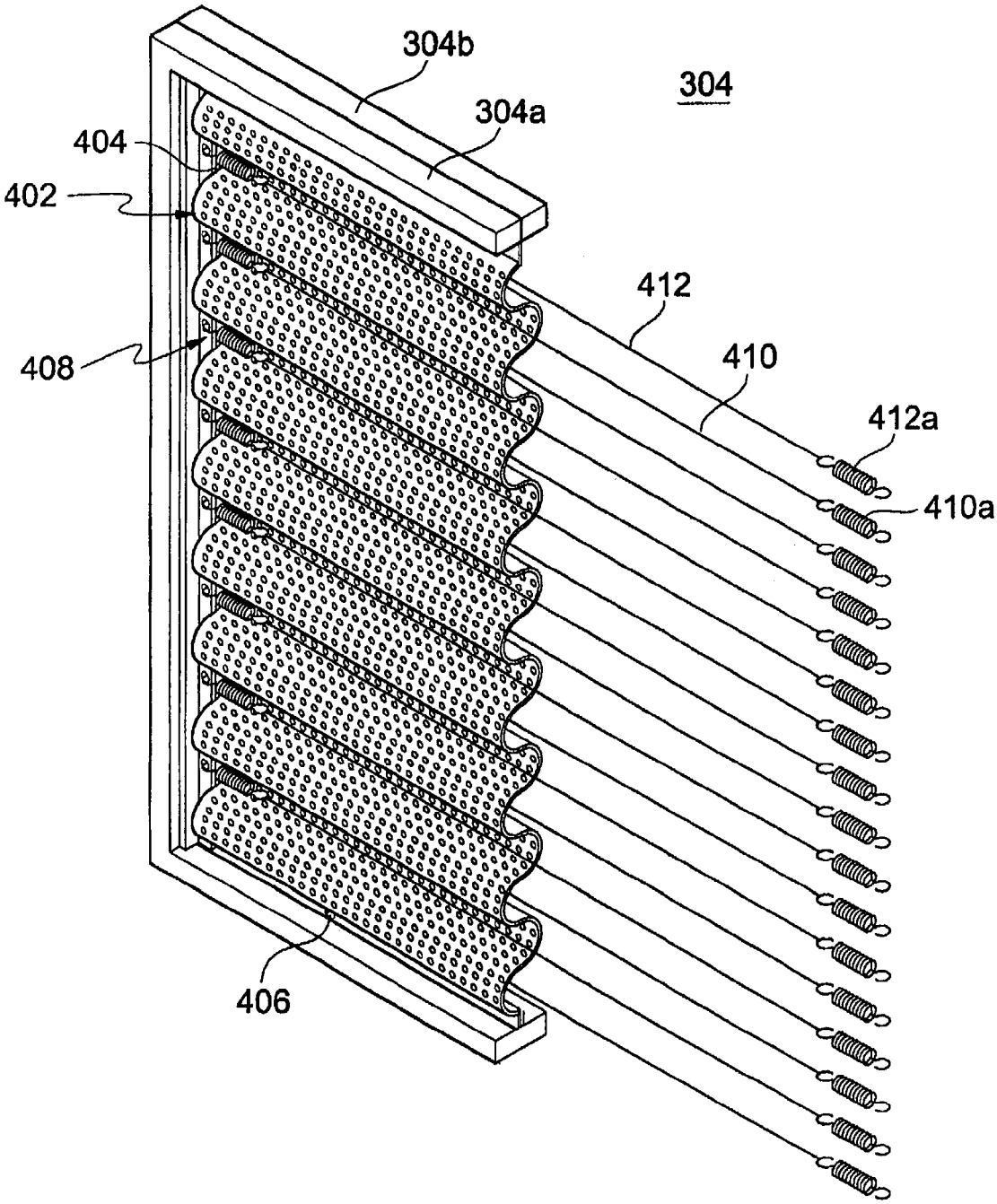
FIG. 4C is a partial view of the ionizer shown in FIG. 4A.

FIG. 4B is a rear perspective view of the ionizer of the air purifier, according to an embodiment of the present invention. As shown in FIG. 4B, the rear view of the ionizer 304 is similar to the front view of the ionizer 304. The discharge electrodes 412 are positioned in the inner spaces defined by corresponding hollow semi-cylindrically shaped electrodes 408, respectively. Additionally, in FIG. 4C, a reference numeral 406 designates a fastening member 406, such as a screw.

Figure 5:
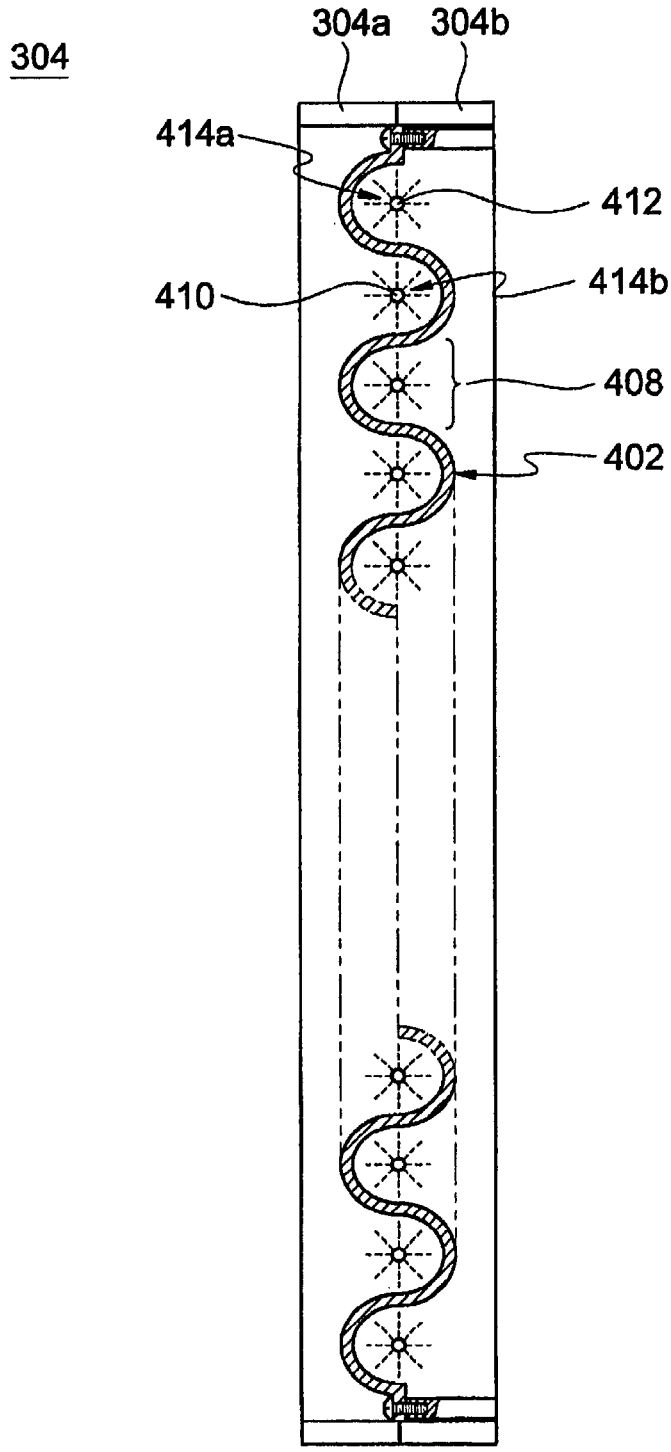
FIG. 5 is a side sectional view of the ionizer of the air purifier shown in FIG. 3.
Figure 6:
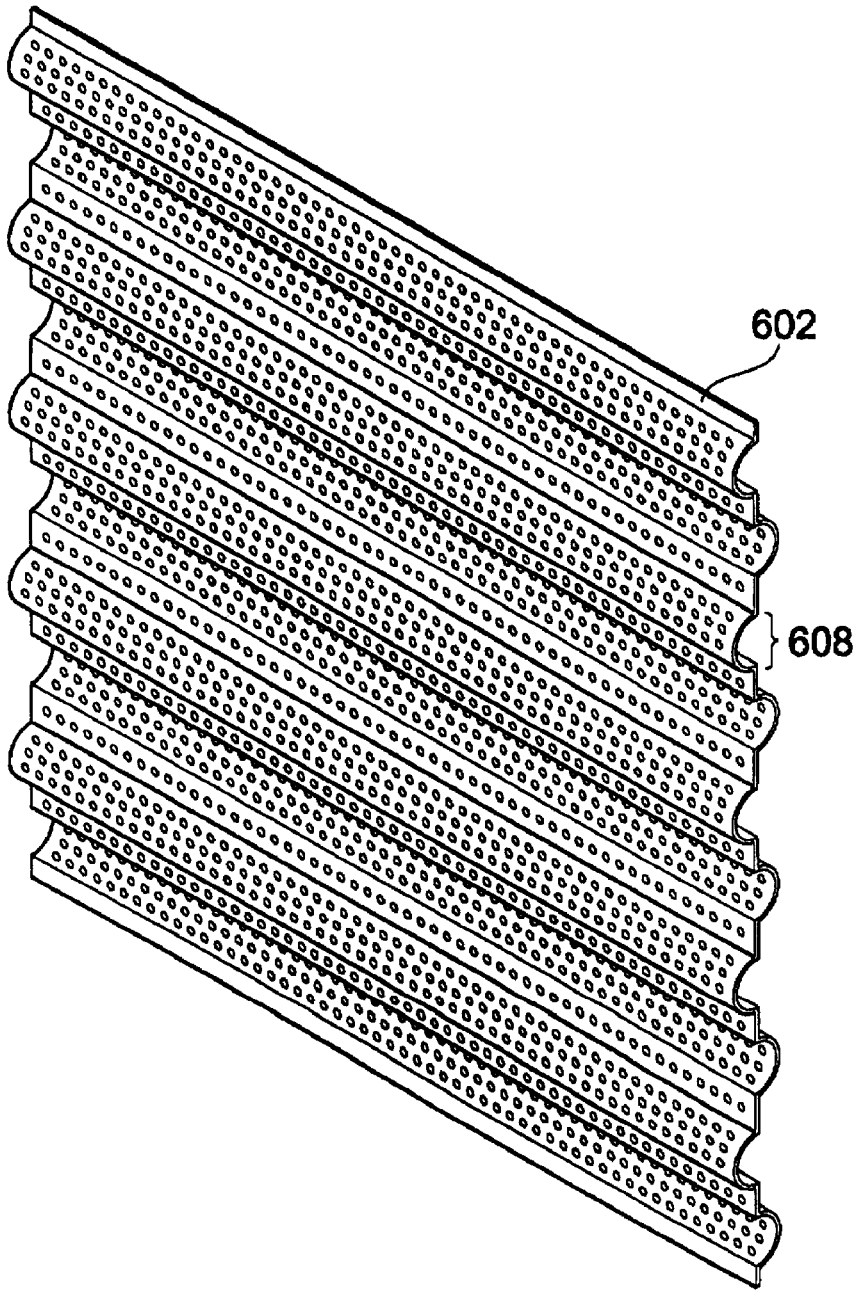
FIG. 6 illustrates a ground electrode unit of the ionizer of the air purifier, according to another embodiment of the present invention.

FIG. 5 is a side sectional view of the ionizer of the air purifier shown in FIG. 3, according to the present invention. As shown in FIG. 5, the discharge electrodes 410 are fixedly positioned in the inner spaces defined by the hollow semi-cylindrically shaped electrodes 408, so that discharge occurs in almost all the inner surfaces of the hollow semi-cylindrically shaped electrodes 408. While dust particles pass through the air holes 404 perforated in the surface of the ground electrode unit 402, the dust particles are positively charged in charging spaces maximally increased. As described above, the charging spaces of the ionizer 304 of the air purifier according to the present invention are maximized, so that the charging efficiency for the dust particles is greatly increased. FIG. 6 shows a ground electrode unit of the ionizer of the air purifier, according to another embodiment of the present invention. As shown in FIG. 6, in a ground electrode unit 602, a plurality of electrodes 608 are formed spaced apart from each other by a predetermined interval.

From dust particles passing through the ionizer 304, relatively large dust particles other than fine dust particles filtered by a high efficiency filter, such as the HEPA filter, do not move in a straight horizontal direction and pass through the ionizer 304 while moving upward and downward, under conditions wherein the flow rate of circulated air is not high. Accordingly, with the corrugated ground electrode unit 402 provided to the ionizer 304 of the air purifier according to the present invention, the charging efficiency for dust particles may be increased. In FIG. 5, dust particles not electrically charged while passing through a discharge space 414*a* move downward and may be electrically charged in another discharge space 414*b*, so that the charging efficiency for dust particles is further increased.

During the manufacture of the ground electrode unit of the ionizer according to the present invention, the manufacture and assembly processes of the ground electrode unit are simplified because a plurality of the electrodes constituting the ground electrode unit are formed as a single plate. That is, if the air holes are perforated in the single plate by a pressing process, and the hollow semi-cylindrically shaped electrodes are formed by bending the perforated plate, the manufacture and assembly processes of the ground electrode unit are simplified compared to a case where a plurality of the hollow semi-cylindrically shaped electrodes are individually manufactured and assembled with each other. Additionally, if the air holes and the hollow semi-cylindrically shaped electrodes are formed as a single part by a casting process, the manufacture and assembly processes of the ground electrode unit are simplified compared to a case where a plurality of the hollow semi-cylindrically shaped electrodes are individually manufactured and assembled with each other.

Additionally, the life of the filters placed behind the electric dust collecting device may be increased due to the increased charging efficiency for dust particles in the ionizer of the air purifier according to the present invention. That is, the charging efficiency for dust particles in the ionizer 304 is greatly increased, and the collection performance of the collector 306 is also increased, so that a filtering burden of a filter, for example, the HEPA filter 308, placed behind the collector 306 may be reduced. A HEPA filter is generally placed behind the electric dust collecting device to collect fine dust particles, mold and the like. Compared to the other filters, it is difficult to provide the HEPA filter with a microstructure necessary for filtering the microparticulates, thus increasing the manufacturing cost thereof. Accordingly, if the charging efficiency for dust particles in the ionizer 304 is greatly increased, and more dust particles are therefore collected, the HEPA filter is replaced less frequently, so that the economic burden of a user may be greatly decreased.

In an embodiment, the present invention includes an ionizing air purifier comprising a wave shaped unit having a plurality of first electrodes connected successively and in parallel and having a plurality of air holes to pass air therethrough; at least two second electrodes positioned at inner spaces defined by the wave shaped unit, respectively; and a collector, proximate to the wave shaped unit, being electrically charged to have a polarity opposite to a polarity of charged dust particles. The wave shaped unit may, for example, be sine wave shaped, square wave shaped, or may include a plurality of wave shapes.

In an embodiment, the present invention includes a ground electrode unit of an electric dust collection device electrically charging dust particles, comprising a wave shaped unit having a plurality of electrodes connected successively and in parallel and having a plurality of air holes to pass air therethrough, wherein the wave shaped unit is manufactured as a single part by a pressing process using a single plate. The wave shaped unit may, for example, be sine wave shaped, square wave shaped, or may include a plurality of wave shapes.

In an embodiment, the present invention includes a ground electrode unit of an electric dust collection device electrically charging dust particles comprising a wave shaped unit having a plurality of electrodes connected successively and in parallel and having a plurality of air holes to pass air therethrough, wherein the ground electrode unit is manufactured as a single part by a casting process. The wave shaped unit may, for example, be sine wave shaped, square wave shaped, or may include a plurality of wave shapes.

As is apparent from the above description, the present invention provides an air purifier which increases the charging efficiency for dust particles through maximally increased discharge spaces and prevents electrical accidents.

Although a few preferred embodiments of the present invention have been shown and described, it is appreciated by those skilled in the art that changes may be made in these embodiments without departing from the principles and spirit of the invention, the scope of which is defined in the claims and their equivalents.

What is claimed is:

1. An air purifier, comprising:

an ionizer comprising a first electrode including a single plate having at least two hollow semi-cylindrically shaped electrodes being connected successively and in parallel and forming a corrugated shape, a plurality of air holes perforated in the surface of the at least two hollow semi-cylindrically shaped electrodes, said air holes having a shape which allows both air and dust particles to pass smoothly therethrough without collection of said dust particles;

at least two second electrodes, the at least two second electrodes comprising discharge wire electrodes for charging said dust particles and being positioned at inner spaces defined by the at least two hollow semi-cylindrically shaped electrodes, respectively; and a collector downstream of said first and second electrodes and electrically charged to have a polarity opposite to a polarity of charged dust particles for collection of said particles on said collector by electrostatic attraction.

2. The air purifier as set forth in claim 1, wherein high voltage is applied to the second electrodes when the first electrode is grounded, and the second electrodes are grounded when high voltage is applied to the first electrode.

3. The air purifier as set forth in claim 1, wherein distances between an inner surface of each of the hollow semi-cylindrically shaped electrodes and a corresponding one of the second electrodes are uniform.

4. The air purifier as set forth in claim 1, wherein the first electrode is manufactured as a single part using a single plate.

5. The air purifier as set forth in claim 1, wherein the first electrode is formed as a single part.

6. The air purifier as set forth in claim 1, wherein the second electrodes are disposed so that a distance between an inner surface of each of the first electrodes and a corresponding one of the second electrodes is uniform.

7. An ionizer of an electric dust collection device, comprising:

a first electrode comprising at least two hollow semi-cylindrically shaped electrodes, each including a plurality of air holes to pass air and dust particles therethrough, said air holes having a shape which allows both air and dust particles to pass smoothly therethrough without collection of said dust particles, the two or more electrodes being connected successively and in parallel so that the first electrode is formed in a corrugated shape;

at least two second electrodes to charge said dust particles for downstream collection, said at least two second electrodes being positioned at inner spaces defined by the hollow semi-cylindrically shaped electrodes, respectively; and a collector downstream of said first and second electrodes and electrically charged to have a polarity opposite to a polarity of charged dust particles for collection of said particles on said collector by electrostatic attraction;

wherein the first electrode is formed as a single part.

8. The ionizer as set forth in claim 7, wherein high voltage is applied to the second electrodes when the first electrode is grounded, and the second electrodes are grounded when high voltage is applied to the first electrode.

9. The ionizer as set forth in claim 7, wherein the first electrode is formed as a single part using a single plate.

10. The ionizer as set forth in claim 7, wherein the first electrode is manufactured as a single part by a casting process.

11. An air purifier, comprising:

a single plate electrode including at least two semi-cylindrically shaped hollow cavities;

a plurality of air holes perforated in the surface of the at least two semi-cylindrically shaped hollow cavities, the air holes having a shape which allows both air and dust particles to pass smoothly therethrough without collection of said dust particles;

discharge wire electrodes to charge the dust particles and being positioned at inner spaces defined by the at least two semi-cylindrically shaped hollow cavities; and a collector downstream of said discharge wire electrodes and said plate electrode and electrically charged to have a polarity opposite to a polarity of charged dust particles to collect the dust particles by electrostatic attraction.

* * * * *